US005712529A

United States Patent [19]

Ricaud et al.

[11] Patent Number: 5,712,529

[45] Date of Patent: Jan. 27, 1998

[54] VACUUM ELECTRONIC TUBE WITH GETTER SUPPORT STRUCTURE

[75] Inventors: Jean-Luc Ricaud, St Ismier; Philippe Gallet, St Nicolas de Macherin, both of France

[73] Assignee: Thomson Tubes Electroniques, Velizy, France

[21] Appl. No.: 537,850

[22] PCT Filed: Mar. 14, 1995

[86] PCT No.: PCT/FR95/00305

§ 371 Date: Nov. 15, 1995

§ 102(e) Date: Nov. 15, 1995

[87] PCT Pub. No.: WO95/25339

PCT Pub. Date: Sep. 21, 1995

[30] Foreign Application Priority Data

Mar. 15, 1994 [FR] France ..... 94 02980

[51] Int. Cl.[6] ..... H01J 19/70

[52] U.S. Cl. ..... 313/558; 313/481; 313/553

[58] Field of Search ..... 313/481, 482, 313/553, 558, 559, 560, 450, 451, 417, 561, 551

[56] References Cited

U.S. PATENT DOCUMENTS

| | | | |
|---|---|---|---|
| 3,334,258 | 8/1967 | Kaplan et al. | 313/481 |
| 4,721,882 | 1/1988 | Van Daelen | 313/481 |
| 5,210,460 | 5/1993 | Utsumi et al. | 313/481 |

*Primary Examiner*—Michael Horabik
*Assistant Examiner*—Michael Day
*Attorney, Agent, or Firm*—Oblon, Spivak, McClelland, Maier & Neustadt, P.C.

[57] ABSTRACT

The invention relates to a vacuum tube, particularly a cathode-ray visual-display tube. In order to absorb residual gases after having formed a vacuum in the tube a getter material (barium) is used, which is evaporated onto the internal walls of the tube from a getter support. According to the invention, instead of the getter support being welded to the electron gun it is independent of the gun and is fixed rigidly to the walls of the neck of the tube, in front of the electron gun. The distribution of the getter material in the tube is thus improved, especially for tubes focused by the neck, that is to say tubes for which the internal wall (covered with graphite) of the neck serves as a cylindrical electrode for focusing the electron beam, taken to the anode potential.

13 Claims, 3 Drawing Sheets

VACUUM ELECTRONIC TUBE WITH GETTER SUPPORT STRUCTURE

FIELD OF THE INVENTION

The invention relates to vacuum electron tubes. It is applicable particularly to cathode-ray visual-display tubes and will be described more precisely in the context of this type of tube.

DESCRIPTION OF THE BACKGROUND

Vacuum electron tubes, as their name indicates, require a high vacuum in an enclosure in which the electrons move. The tube is therefore pumped out during manufacture before it is finally closed. However, this pumping does not make it possible to form and conserve an absolute vacuum: particularly because a phenomenon of "outgassing" occurs during the latter stages of manufacture and during the subsequent use of the tube. Outgassing is the freeing of gaseous molecules present in certain components within the tube.

Vacuum tubes, and particularly cathode-ray visual-display tubes, therefore always include a material for absorbing the residual gases; this material is called "getter". It is placed within the tube and has strongly absorbing properties for the residual gas molecules which are found in the tube. Barium is a material very widely used as getter.

To be effective, the getter has to exhibit as large a surface area as possible; this is because absorption takes place in proportion to surface area. Hence a very fine layer of getter is deposited over part of the internal walls of the vacuum tube in order to take advantage of as large a surface area as possible. Moreover, this deposition is obviously not carried out until the vacuum has been formed within the tube, as the getter would immediately be saturated and would no longer fulfil its purpose of eliminating the residual gases after pumping.

For this reason, in the prior art, the getter is usually installed in the following way, for a cathode-ray tube including a bulb and a neck with an electron gun mounted in the neck: a trough containing the material of the getter is mounted on a support, which is itself fixed to the electron gun. The gun and getter support assembly is inserted into the neck. The tube is then closed. The vacuum is formed by pumping through a stem. Then the stem is closed, finally sealing the tube.

Only then is the getter evaporated onto the walls of the tube. Evaporation is carried out by heating the material at high frequency by induction, through the walls of the neck, up to a temperature of about 800° to 1000° C. At this temperature an exothermic reaction is triggered between the components present in the trough (generally a sintered powder of aluminium and of barium, $Al_4Ba$), and the evaporation process continues until the getter material is exhausted. The evaporation is directional, in all the directions allowed by the shape of the walls of the trough containing the starting material. These walls are shaped and oriented so that the barium comes to be deposited on the walls of the tube.

The constraints on installing and producing the getter support are many, particularly:

- the getter and its support, which remain present throughout the life of the tube, must not interfere with the optics for electrostatic focusing of the electron beam emitted by the gun;
- the getter and its support must not interfere with the coils for magnetic deflection of the electron beam;

- the getter must not be deposited on the various components of the electron gun (insulating parts which would risk being short-circuited, or conducting parts which would come to emit spurious electrons since barium is a material of very high electron emissivity);
- the technology for fabricating and installing the getter support must not be too expensive;
- the getter support must be held solidly in place if the tube is subjected to strict constraints on resistance to impacts and to acceleration.

In the prior art, the getter support is fixed, generally by welding, onto an electrode of the electron gun. This electrode is, in principle, the final electrode at the front end of the gun (the final electrode forwards, that is to say in the direction of the electron beam emitted by the gun); this end electrode is linked to the highest operating voltage of the tube, called screen voltage; there is generally no difficulty then: the trough containing the getter can be turned towards the front for evaporation onto a large surface area in the neck in front of the gun or even as far as the bulb. There is little risk of the barium returning towards the components of the electron gun; the getter support does not impair electrostatic focusing since it is at the potential of the final electrode which is equal to the potential of the conducting internal walls of the bulb and of the front of the neck; sometimes it is even the getter support itself which serves to lead in the high voltage from the conducting internal walls to the final electrode of the gun: it is welded onto this electrode and it comes into contact at its periphery with the conducting walls (at very high voltage) of the neck. Finally, in this structure, the getter support is held solidly in place since it is fixed to the electron gun, which is itself rigidly fixed to the base cap of the tube.

However, in the case of some tubes, the final electrode of the gun is not at the potential of the conducting walls of the tube, and the structure described above cannot be adopted. This is the case, for example, for tubes called "tubes focused by the neck", in which the electrostatic focusing uses the conducting cylindrical walls of the neck as final electrode.

In the prior art, for these tubes, the getter support is therefore fixed onto one electrode of the electron gun, then with the obligation, however, to orient the getter trough or troughs in a radial direction around the gun, that is to say towards the tube walls immediately surrounding these troughs. There is then the drawback of a smaller wall surface area covered by getter. For this type of tube, it has also been proposed to mount the getter support in front of the gun, and separate from the gun; the getter support is inserted elastically into the neck of the tube, before assembling the gun and closing the tube. This mounting appears hardly satisfactory as far as resistance to impacts and acceleration is concerned, since the getter support is not integral with the gun.

SUMMARY OF THE INVENTION

According to the invention, it is proposed to mount the getter support, on the one hand, and the electron gun, on the other hand, in two distinct parts which are not integral with one another; the getter support is placed in front of the final electrode of the gun; the trough is turned towards the front, and the getter support is rigidly fixed to the neck by a glass paste.

More precisely, the invention proposes a vacuum electron tube comprising a neck and a bulb with an electron gun placed in the neck and turned towards the bulb, a getter support also being placed in the neck, characterized in that the getter support and the gun constitute separate assemblies not integral with one another, the getter support being placed in front of the gun and being fixed rigidly to the neck.

The getter support preferably includes an annular trough containing a getter material, this trough being oriented towards the bulb symmetrically around the axis of the gun. This trough may be ring-shaped with a U cross-section.

The tube is preferably a tube focused by the neck, the inner walls of the neck being coated with a conducting material, particularly graphite, in order to form a cylindrical electrostatic focusing electrode intended to be taken to a potential higher than the potential of the final electrode at the front of the gun. However, the invention can also be applied, although in a less beneficial way, in the case of a tube in which the electrostatic focusing takes place entirely via the various electrodes of the gun, the final electrode of the gun being at the potential of the walls of the tube.

The getter support preferably includes a collar concentric with the axis of the neck, of lesser diameter than that of the neck, and elastic tabs fixed to the collar and extending beyond the internal diameter of the neck, these tabs being able to be brought back radially to this diameter in order to allow forcible insertion into the neck, the tabs bearing on the inner walls of the neck in order to hold and centre the getter support in the tube.

The ends of the elastic tabs are sealed to the inner walls of the neck, and the sealing material is preferably a glass paste capable of being modified irreversibly, for example by crystallization. Such glass pastes, such as that sold under the trade mark "pyroceram", are widely used to carry out vacuum-tight sealing, of glass to glass or of metal to glass.

This paste is solid at normal temperature, which allows the getter support to be inserted into the neck before carrying out the sealing of the tabs against the walls of the neck (a liquid or viscous adhesive would not allow the support to be inserted without leaving unacceptable traces on the walls).

The tabs come to bear on the inner walls of the neck in a region which is generally covered with conducting material but which, however, is preferably devoid of conducting material at the site of the contact between the tabs and the wall.

BRIEF DESCRIPTION OF THE DRAWINGS

Other characteristics and advantages of the invention will emerge on reading the detailed description which follows and which is given with reference to the attached drawings in which.

DESCRIPTION OF THE PREFERRED EMBODIMENTS

Figure 1:
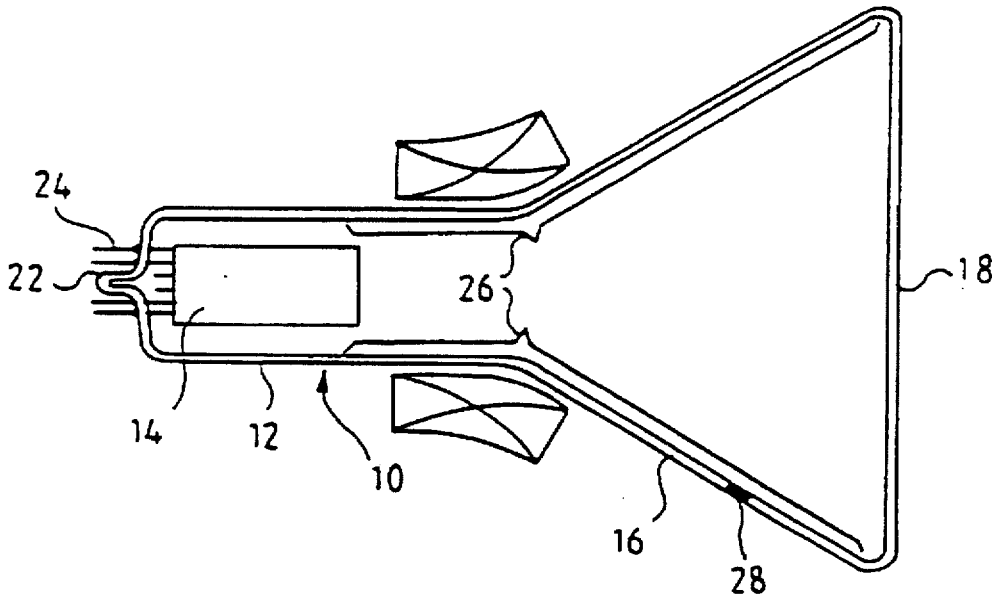
FIG. 1 is a general view of a cathode-ray tube.

FIG. 1 represents a general view of a cathode-ray visual-display tube which comprises a sealed glass enclosure 10 in which a vacuum is formed; the rear part of the enclosure is in the form of a narrow cylindrical neck 12 and contains an electron gun 14; the neck is linked to a bulb 16 which flares out towards the front, that is to say in the direction of the visual display screen; the bulb is closed to the front by a frontal wall 18 on which a cathodoluminescent layer is deposited, constituting the visual display screen. The neck is closed at its rear part by a base 20 terminated by a stem 22; the stem is open during pumping of the tube and then permanently closed. Connecting pins 24 pass through the base in order to bring in the appropriate electrical voltages from the outside of the tube to the various electrodes of the gun 14.

Magnetic deflection coils surround the neck 12 in front of the electron gun.

The walls of the tube situated in front of the electron gun must be taken to the high anode voltage, that is to say to the highest potential which is the potential of the visual display screen. For this reason, in the general case of glass tubes, there is provision for the internal walls of the tube (neck and bulb) to be covered by a fine layer of conducting material (generally graphite). This covering is applied only to the front of the electron gun or with a slight overlap around the front end of the gun. The graphite-covered area is indicated by the reference 26 in FIG. 1.

The high voltage is applied, in general, via a connection 28 passing through the wall of the bulb and linked to the graphite-covered area and to the visual display screen. The other operating voltages for the tube are led in by the connection pins 24 situated on the base 20 of the neck 12.

Figure 2:
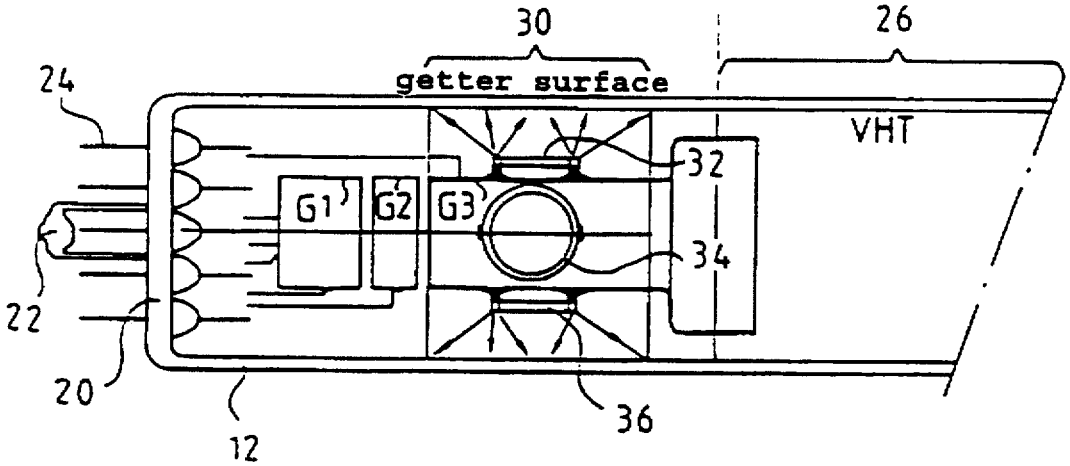
FIG.2 PRIOR ART
FIG. 2 represents an electron gun assembly with a getter support of the prior art.
Figure 3A:
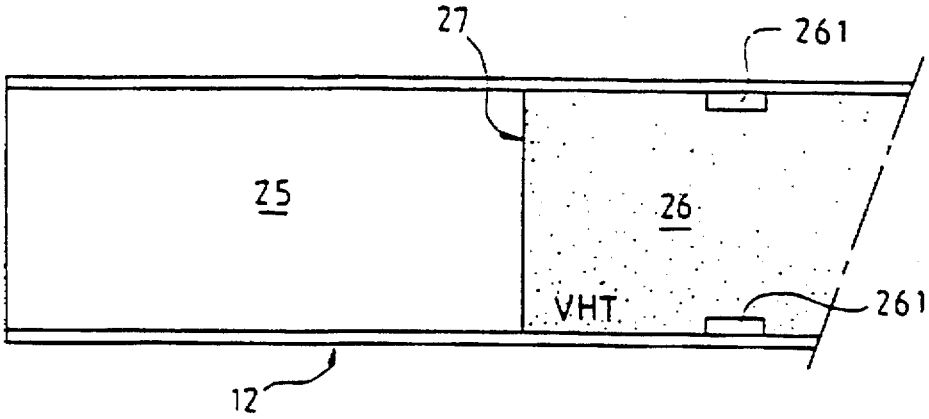
FIGS. 3*a*–3*d* represents an exploded view of the various components of the tube according to the invention, before assembly: neck, electron gun, getter support, neck base.
Figure 3D:
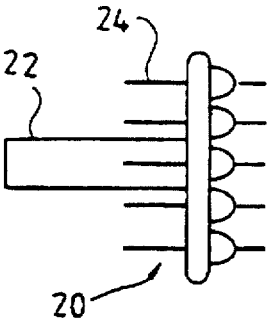
Figure 3B:
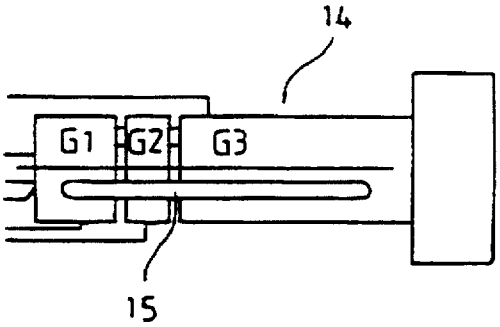
Figure 3C:
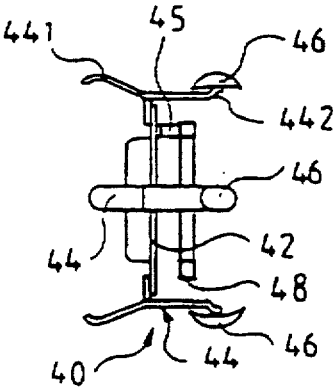

FIG. 2 represents a conventional layout of an electron gun with a getter support in an example in which the electrostatic focusing of the beam is focusing by the neck, that is to say that focusing is carried out both by the electrodes of the gun and by the conducting cylindrical wall of the neck surrounding the gun immediately in front thereof.

The gun here includes several cylindrical electrodes G1, G2, G3 linked electrically (by links which are not represented) to various connection pins 24 leading in the necessary potentials VG1, VG2, VG3 onto these electrodes. The final electrode of the gun, G3, is at a potential VG3 which is not the EHT potential of the high anode voltage to which the wall of the neck is taken in the area 26, but is equal, for example, to one quarter of this EHT potential.

The getter support is still welded to the gun, if only for reasons of mechanical behavior. However, as it cannot be fixed on the front part of G3 without disturbing the focusing, it then has to be mounted in such a way that the getter trough or troughs are turned radially towards the cylindrical wall of the neck and not axially towards the front of the tube. It is possible, for example, to fix three or four getter troughs 32, 34, 36 regularly distributed around the electrode G3, turned towards the neck wall which immediately surrounds this electrode G3. The barium will be evaporated, and will then be deposited on this neck part, designated by the reference 30. This surface area is, unfortunately, fairly limited because of the proximity of the getter troughs and the wall of the neck.

It will be noted that the elements which serve to keep the electrodes of the gun integral with one another have not been represented in FIG. 2; these elements are generally glass bars into which tags provided on the electrodes are set. Neither have the elements (collars surrounding the gun and equipped with elastic tabs bearing on the internal walls of the neck) which serve to center the gun in the neck been represented.

Figure 4:
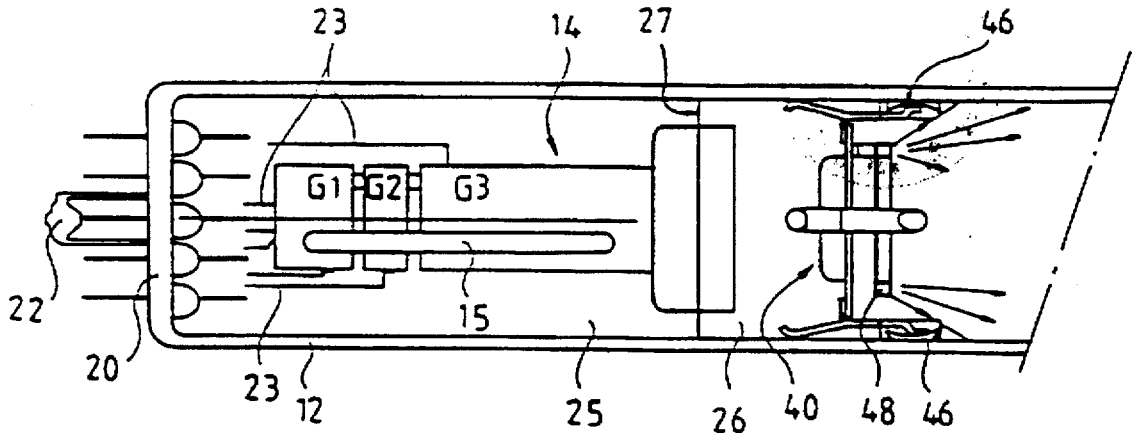
FIG. 4 represents a view of the tube according to the invention, assembled.

In order to obtain a better distribution of the getter material within the neck and the bulb, a tube structure is provided as represented in FIGS. 3 and 4 in one preferred embodiment.

The elements similar to those of FIGS. 1 and 2 bear the same numerical references.

The gun and the getter support are now elements which are not integral with one another; they consist of two separate structures, inserted one after the other into the neck 10 of the tube and not mechanically linked to one another other than by the walls of the tube.

FIG. 3 represents the component elements of the gun before assembly, and FIG. 4 represents these same elements assembled.

The four elements represented in FIG. 3 are: a) the cylindrical neck 12 of the tube (the bulb is not represented); b) the electron gun 14; c) the getter support 40; and d) the base 20 serving to close off the rear of the neck.

As previously, the internal walls of the neck are partially covered by a conducting material (graphite in principle) in the area 26 represented by a shading of dots. There is no conducting material in the area 25 situated to the rear of the neck. In practice, as can be seen in FIG. 4, for a tube with focusing by the neck, the boundary 27 between the conducting wall area 26 and the non-conducting wall area 25 is situated approximately opposite the end of the final electrode G3 of the gun (there is a slight overlap between the conducting area 26 and this final electrode).

Small areas 261, in the middle of the area 26 in front of the boundary 27, are devoid of graphite. These areas correspond to points of bonding of the getter support 40 in front of the electron gun 14, and it is preferable for there not to be any graphite at the site of these points.

The base 20 of the neck exhibits no specific characteristic related to the invention: it is a glass plate traversed in a vacuum-tight way by the connection pins 24, with a pumping stem 22.

The electron gun may be conventional, identical, for example, to that represented in FIG. 2, with a cathode and a heating filament, which are not visible, and 3 electrodes G1, G2, G3. Focusing by the neck means that the electrode G3 is at a lower potential than the high voltage EHT applied to the conducting wall area 26. The area 26 then itself serves as final electrostatic focusing electrode, but does not form part of the individual gun structure.

The gun is an individual structure in the sense that the various electrodes are mounted in a rigid assembly before insertion into the neck of the tube. The most conventional assembly for securing the electrodes to one another consists in using insulating bars 15, generally made of sintered glass, extending parallel to the axis of the gun along all the electrodes, several electrodes (or most often all the electrodes) being fixed to each of the bars.

The getter support, intended to be mounted in front of the gun without being linked thereto, preferably includes an annular collar 42 the centre of which is left free for the electron beam coming from the gun to pass through. At the periphery of this collar tabs 44 are fixed, having a certain radial elasticity. The ends of tabs, in the rest position, extend radially at a distance from the center of the collar which is greater than the radius of the internal wall of the neck 12. Hence these ends of tabs can bear elastically against the internal wall of the neck.

The tabs are preferably double, that is to say that each tab 44 includes one branch 441 extending rearwards of the collar and one branch 442 extending forwards of the collar, the ends of each branch bearing on the internal wall of the neck. At one end, one of the branches of each tab preferably carries a pellet of material which can be bonded or welded to the wall of the neck. This pellet is designated by the reference 46. It is made of solid material so that the support can be forceably (elastically) inserted into the tube without leaving traces on the neck.

Finally, the getter itself is fixed on the collar; the getter preferably consists of an annular trough 48, with a U cross-section, containing the getter material (consisting of barium-aluminium). The opening of the U cross-section is turned forwards in the axis of the electron gun so that evaporation of the material takes place forwards (directional evaporation). The trough 48 is annular, and thus possesses a central aperture so as to let through the electron beam from the gun. It is welded onto the collar 42 of the support, by means of one or more fixing tabs 45 which hold it in the axis of the neck.

The getter support is placed in front of the gun and therefore has to be inserted before the gun if the gun is inserted through the rear end of the neck (which is generally the case). The getter support is pushed into the axis of the neck until the pellets 46 arrive opposite the areas 261 devoid of graphite. The elasticity of the tabs keeps these pellets pressed against these areas. During subsequent heat treatment of the tube in an oven at about 410° C., the softening temperature of the glass of the walls, the pellets are welded to the wall in the areas 261. This heat treatment is not necessarily a supplementary manufacturing stage, it can take place during the pumping of the tube, that is to say during the operation by which the vacuum is formed within the tube.

The getter support is then held centered in the tube, in front of the position of the electron gun and independently thereof. The distance between the final electrode of the gun and the getter support is preferably about equal to the diameter of this final electrode (the furthest forward). The getter support must not be too close, in order not to adversely alter the distribution of the equipotentials in the neck, and moreover it is preferable that it is not situated within the magnetic focusing coils of the tube.

The electron gun is fixed onto the base 20 of the neck, the connection pins 24 being welded to corresponding pins 23 welded to the various electrodes of the gun (cathode, heating filament, and focusing electrodes). The electron gun is then inserted into the neck and the base 20 closes off the rear of the tube. Pumping is carried out through the stem 22 at a temperature which allows the pellets 46 to be welded onto the walls of the neck.

The welding of the getter support is an important stage if it is desired that the getter support be very firmly held in the neck even under severe conditions of acceleration and of impacts. The prior assemblies always provided for the getter support to be welded onto the gun for this reason.

It has been noticed, according to the invention, that it was possible to separate the getter support from the gun particularly when the following method is used for fixing the getter support: the pellets 46 consist of a crystallizable glass (glass with a high concentration of lead), for example of the type sold under the trade mark "pyroceram" currently serving to produce vacuum-tight welds, glass-glass or glass-metal. They are initially placed at the end of the tabs 442 of the getter support in the form of a viscous paste which is the crystallizable glass in powder mixed with a solvent. It would not then be possible to insert the support into the tube with this viscous paste which would be deposited by rubbing against the walls upon insertion. The getter support was therefore temporarily taken to a sufficient temperature for a sufficient time to harden the paste by evaporation of the solvent and partial sintering of the glass, without irreversible crystallization of the material. The temperature is about 390° C., for example, and the duration several tens of minutes, for example one hour. Permanent, irreversible crystallization occurs only at a higher temperature (about 410° C. for about 1 hour) during pumping of the tube, while the getter support is in its place in the neck. Final welding of the getter support takes place in principle in the pumping kiln, but it could also take place by local heating, by a flame or by induction through the walls of the neck.

Figure 5:
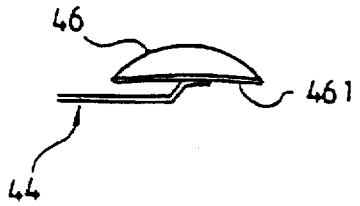
FIG. 5 represents a detail of an elastic tab of the getter support.

FIG. 5 represents a detail of the embodiment of the pellets 46 at the end of the tabs 44. A metal dome 461 is welded to the end of a tab 44. The material of this dome is chosen to have an expansion coefficient compatible with that of the crystallized glass of the pellet 46; this material is preferably an alloy of iron, nickel and chrome. The crystallizable glass paste is deposited on this dome 461. The other metal parts of the getter support can be made of stainless steel.

After pumping of the tube, the getter material is evaporated. To do that, heating of the getter is carried out by induction through the outside of the neck. The material evaporates directionally towards the front of the neck, the walls of the U cross-section of the trough defining the directional limits of evaporation of the material.

The getter material (barium) is deposited on the neck in front of the getter support and on the internal walls of the bulb. The electron gun is completely protected since it is situated completely behind the getter support.

After evaporation of the getter material, the getter support obviously remains in place in the neck in front of the gun.

We claim:

1. Vacuum electron tube comprising:

a neck;

a bulb;

an electron gun disposed in the neck and aimed towards the bulb; and a getter support disposed in the neck, wherein the getter support and the electron gun comprise separate assemblies not integral with one another, and wherein the getter support is disposed in front of the electron gun and is fastened rigidly to the neck said getter support including:

a collar concentric with an axis of the neck and having a diameter less than an internal diameter of the neck; and elastic tabs disposed on the collar and extending in a rest position beyond the internal diameter of the neck, the elastic tabs being able to be brought back radially to the internal diameter of the neck in order to allow forcible insertion of the getter support into the neck, the elastic tabs bearing on and being sealed to at least one inner wall of the neck in order to center the getter support with respect to the axis of the neck.

2. Tube according to claim 1, wherein the getter support further includes an annular trough containing a getter material, said trough being oriented towards the bulb and arranged symmetrically around the axis of the neck.

3. Tube according to claim 2, wherein the trough is ring-shaped and has a U cross-section open towards a front of the tube.

4. Tube according to claim 3, wherein said tube is a cathode-ray visual display tube, and wherein a front end of the bulb is closed by a front wall covered with a cathodoluminescent layer forming a screen.

5. Tube according to claim 2, wherein said tube is a cathode-ray visual display tube, and wherein a front end of the bulb is closed by a front wall covered with a cathodoluminescent layer forming a screen.

6. Tube according to claim 1, wherein at least one inner wall of the neck is coated with a conducting material in order to form a cylindrical electrostatic focusing electrode intended to be taken to a potential higher than a potential of a final electrode of the gun to thereby focus the tube.

7. Tube according to claim 6, wherein said tube is a cathode-ray visual display tube, and wherein a front end of the bulb is closed by a front wall covered with a cathodoluminescent layer forming a screen.

8. Tube according to claim 1, wherein the elastic tabs are welded to said at least one inner wall with a sealing material comprising a glass paste capable of solidifying irreversibly.

9. Tube according to claim 8, wherein said tube is a cathode-ray visual display tube, and wherein a front end of the bulb is closed by a front wall covered with a cathodoluminescent layer forming a screen.

10. Tube according to claim 8, wherein said glass paste comprises a material capable of solidifying irreversibly by crystallization.

11. Tube according to claim 1, wherein the tabs press on said at least one inner wall of the neck in at least one non-conducting region proximate to at least one region covered with conducting material, said at least one non-conducting region being devoid of conducting material at at least one site of contact between the tabs and said at least one inner wall.

12. Tube according to claim 11, wherein said tube is a cathode-ray visual display tube, and wherein a front end of the bulb is closed by a front wall covered with a cathodoluminescent layer forming a screen.

13. Tube according to claim 5, wherein said tube is a cathode-ray visual display tube, and wherein a front end of the bulb is closed by a front wall covered with a cathodoluminescent layer forming a screen.

* * * * *